United States Patent [19]

Day et al.

[11] 4,053,393

[45] Oct. 11, 1977

[54] CYCLONE ASSEMBLY

[75] Inventors: Roger W. Day; George S. Ormsby; Elvis Rich, all of Houston, Tex.

[73] Assignee: Picenco International, Inc., Houston, Tex.

[21] Appl. No.: 633,405

[22] Filed: Nov. 19, 1975

[51] Int. Cl.[2] ..... B04C 5/085

[52] U.S. Cl. ..... 209/211; 220/63 R

[58] Field of Search ..... 209/144, 211; 210/512 R; 220/63 R; 55/435, 459, 267; 138/147

[56] References Cited

U.S. PATENT DOCUMENTS

| | | | |
|---|---|---|---|
| 242,781 | 6/1881 | Tourette | 138/147 |
| 2,622,735 | 12/1952 | Criner | 209/211 |
| 2,816,658 | 12/1957 | Braun et al. | 209/211 |
| 3,360,909 | 1/1968 | Barnerias | 209/144 X |
| 3,386,588 | 6/1968 | Ades | 209/211 X |
| 3,988,239 | 10/1976 | Malina | 209/211 |

*Primary Examiner*—Frank W. Lutter
*Assistant Examiner*—Ralph J. Hill
*Attorney, Agent, or Firm*—Browning, Bushman & Zamecki

[57] ABSTRACT

A cyclone assembly comprising a hollow body having a generally conical portion and a tubular insert body having a generally conical portion disposed at least partially within said hollow body coaxial therewith and adjacent the smaller end of the conical portion of said hollow body, the hollow body and the insert body having interengageable formations, projecting as to one of the bodies and receiving as to the other, for preventing longitudinal movement of the insert body with respect to the hollow body.

30 Claims, 6 Drawing Figures

CYCLONE ASSEMBLY

BACKGROUND OF THE INVENTION

1. Field of the Invention

The present invention pertains to cyclones for separating fluids into components of different weights or densities. A typical cyclone comprises a housing, the major portion of which is conical. The housing may also include cylindrical portions adjoining the opposite ends of the conical portion. The fluid to be separated may, for example, comprise a liquid having a slurry of solid particles suspended therein. This fluid is injected into a blind annular space at the large diameter end of the cyclone housing by an inlet which directs the fluid tangentially against the inner wall of the housing. The fluid thus begins to flow along the inner wall in a path spiraling away from the large end. The reduction in diameter along the conical section of the housing wall causes angular acceleration of the flowing fluid. The heavier constituents settle radially outwardly toward the wall under centrifugal force and continue spiraling along the wall, while the lighter constituents reverse axial direction and flow upwardly and are removed through an outlet located centrally in the large end of the housing. The heavy constituents are removed through a second outlet at the small end. Thus the fluid is separated into two components. One component may be primarily liquid and the other primarily solid particles, for example, or one component may consist of liquid containing relatively small suspended particles and the other component of liquid containing larger particles. One or both components may be directed into another cyclone or other separating device for further separation of constituents.

As mentioned above, the fluids handled by cyclones often contain solid particles, and these particles are often of an abrasive nature. Abrasion by the particles is increased by the high angular velocities at which they move along the sides of the cyclone housing. As the angular velocity and gravitational forces increase toward the small end of the cyclone, the abrasive wear effect becomes more pronounced, reaching a peak near the small end (solids) outlet. To protect the relatively expensive housing from such abrasion, a liner, whose configuration generally parallels that of the housing, is often disposed therein. When the liner becomes worn, it can be removed and replaced more easily and economically than could the cyclone housing.

Removable liners of one piece construction which cover the entire side wall of the housing, while substantially reducing the expense of housing repair or replacement, still involve waste in that their smaller diameter portions may become badly worn while the larger portions near the inlet are still in acceptable condition. This is due to the high velocities and gravitational forces adjacent the walls of the smaller diameter portions.

2. Description of the Prior Art

Various liner systems have been devised in an effort to provide a separate liner part for the smaller diameter portion of a cyclone housing. However, there has been great difficulty in designing such a system having simple but effective means for retaining the small liner part properly in place in the cyclone.

U.S. Pat. Nos. 3,136,723 to Erwin et al and 3,057,476 to Gilbert each disclose liners having large and small diameter parts in axial or endwise abutment. In each case precision fits are required between the various parts of the liner and housing to prevent leakage, interference with proper flow, and other problems. Such precision fits are expensive, as they require such procedures as machining of the housing, and are sometimes virtually impossible to provide.

U.S. Pat. Nos. 2,622,735 to Criner and 3,902,601 to Townley each disclose a generally conical cyclone shell having an apex lining part disposed in its smaller diameter portion. In each case, the small lining part is prevented from upward movement, i.e., toward the large end of the shell, by a shoulder in the shell which abuts the upper and large end of the small lining part. However, movement in the opposite direction is prevented only by means disposed adjacent the small end or lower end of the small lining part. This is a distinct disadvantage, particularly if the lining part is formed of a relatively soft or flexible material, since its large or upper end can move about independently of the lower end causing an interruption in the desired smooth configuration of the surface over which the fluid will flow. Another disadvantage of the means for preventing downward movement of the small lining part in the Criner and Townley patents is that in each case this means includes at least one part separate from the lining and shell which serves as a retainer and which is removed when changing the small lining part.

SUMMARY OF THE INVENTION

The present invention provides improved means for maintaining proper positioning of a small diameter lining part or insert body with respect to a hollow body such as a cyclone housing or a large diameter lining part.

In the cyclone assembly of the present invention, the hollow body has a generally conical portion. The tubular insert body also has a generally conical portion disposed at least partially within the hollow body coaxial therewith and adjacent the smaller end of the conical portion of the hollow body. The hollow body and insert body have interengageable formations, projecting as to one of the bodies and receiving as to the other, for preventing longitudinal movement of the insert body with respect to the hollow body.

In preferred embodiments of the invention, the aforementioned formations include an internal circumferential recess in the conical portion of the hollow body and an external circumferential projection adjacent the larger end of the conical portion of the insert body. In particular, the formations may comprise a generally axially facing first stop surface on the projection of the insert body and an abutting oppositely directed first stop surface formed in the recess of the hollow body. The first stop surfaces are preferably disposed intermediate the ends of the conical portion of the insert body, with the first stop surface of the insert body facing toward the smaller end of the conical portion of the insert body.

An edge surface, common to the large end of the conical portion of the insert body as a whole and to its projection, may serve as a second stop surface abutting an opposed second stop surface within the recess of the hollow body.

The upper edge of the insert body and an abutting axially facing surface on the interior of the hollow body may be specially configured to provide a firm locking action and to facilitate removal of the insert body, especially if the latter is flexible. If the hollow body is the upper liner part or liner body, the firm, close fitting lock between the liner body and the insert body provided by the interengageable formations of the invention eliminate the need for machining of the housing which surrounds the liner.

It is thus a principle object of the present invention to provide a cyclone assembly having improved means for maintaining proper positioning of an insert body in the smaller portion of a conical body.

Still another object of the present invention is to provide improved means for controlling and retaining the large end of a flexible insert for a conical body.

A further object of the present invention is to provide a hollow body and insert body having interengageable formations, projecting as to one of the bodies and receiving as to the other.

Still another object of the present invention is to provide means for longitudinally retaining an insert body in a hollow body of a cyclone assembly without the need for a separate third retainer part.

Numerous other objects, features, and advantages of the present invention will be made apparent by the following description of the preferred embodiments, the drawings, and the claims.

DESCRIPTION OF THE PREFERRED EMBODIMENTS.

Figure 1:
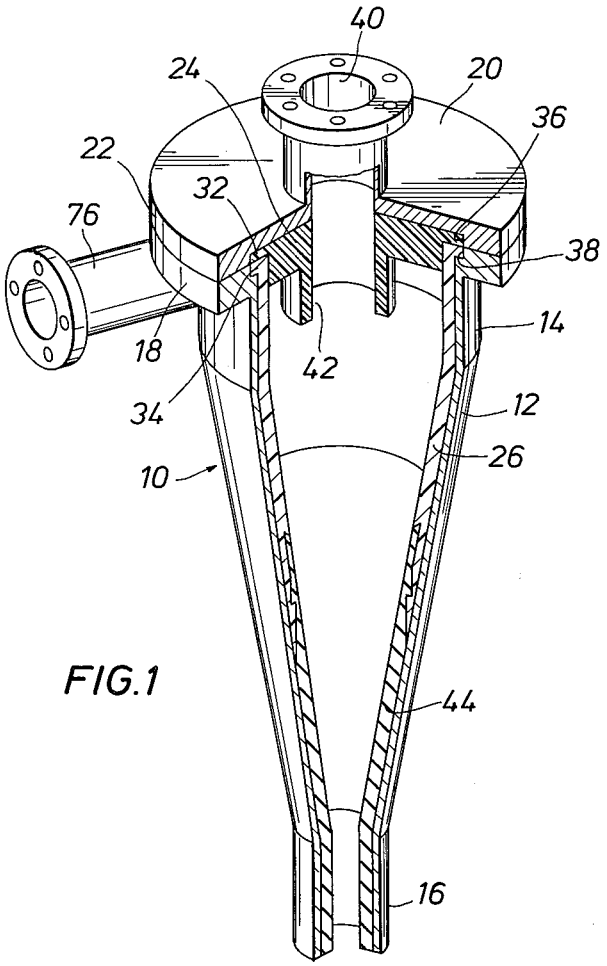
FIG. 1 is a perspective view, with part broken away, of a cyclone assembly incorporating a first embodiment of the invention.
Figure 2:
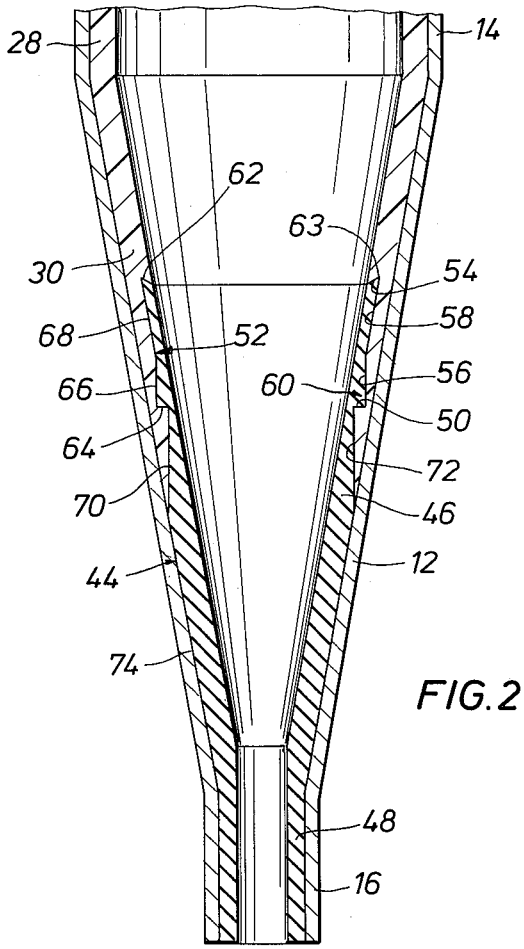
FIG. 2 is a partial longitudinal cross section of the assembly of FIG. 1.

Referring now to FIGS. 1 and 2, there is shown a cyclone assembly comprising a housing 10 having a conical portion 12. It should be stated at this point that terms such as "upward", "downward", "top", "bottom", "upper", and "lower" are used herein for convenience with reference to the operation of the device with its axis vertical and the apex of the conical portion at the bottom as shown in the embodiments depicted in the drawings. Thus the "top" or "upper end" of the conical portion will be the large end, etc. The device will, however, operate substantially with equal efficiency regardless of whether the cone points upwardly, downwardly or strictly horizontally. Earth's gravity has substantially no effect upon the separating operation. Thus language such as that cited above should not be construed to imply any particular orientation of the device in actual practice.

Referring once again to the drawings, the housing 10 comprises a large diameter cylindrical portion 14 adjoining the large or upper end of the conical portion 12 and a small diameter cylindrical portion 16 adjoining the lower end of the conical portion 12. The free ends of cylindrical portions 14 and 16 are open, and a flange 18 extends radially from the open end of portion 14. A cover 20 is disposed over the open end of cylindrical portion 14 and includes a radial flange 22 which mates with flange 18. The flanges 18 and 22 may be attached together in any suitable manner.

The cyclone assembly further comprises a cover liner 24, covering the lower interior surface of cover 20, and a liner body 26 lining the upper portion of the interior wall of the housing 10. Like the portion of housing 10 which it covers, liner body 26 has an upper cylindrical portion 28 and a lower generally conical portion 30. Cover liner 24 and liner body 26 are held in place in the cyclone by respective radially extending flanges 32 and 34 received in respective radial notches 36 and 38 in flanges 22 and 18 and clamped therebetween. Cover 20 has a central axial outlet 40 and cover liner 24 has a downwardly depending annular vortex finder 42 communicating with outlet 40 for collecting the lighter constituents which, during operation of the device, flow upwardly in the vortex of the cyclone. The open lower end of portion 16 forms a second outlet for the cyclone.

As shown, the cover liner 24 and liner body 26 are formed of a relatively rigid synthetic plastic material. However it should be understood that numerous other materials could be used. Depending on the intended use of the cyclone, the materials may be chosen for various characteristics such as resistance to abrasion by the particular material to be handled, inexpensiveness, relative rigidity or flexibility, etc., or for a balance of a number of these characteristics. Non-exhaustive examples of materials which might be used include: various metals; ceramics; synthetic materials of various hardnesses; natural and synthetic elastomers, both hard and soft; etc.

In addition to the parts enumerated above, the cyclone assembly further comprises a tubular insert body 44 having its upper end disposed within the liner body 26 coaxial therewith and adjacent the lower end of the conical portion 30. Insert body 44 covers the lower part of the housing 10 and, with the liner body 26, comprises the housing liner. Like the part of the housing which it covers, insert body 44 has an upper generally conical portion 46 and a lower cylindrical portion 48. An inlet pipe 76 communicates with the interior of cylindrical portion 28 of liner body 26 to direct incoming fluid tangentially against portion 28 in the blind annular space defined by portion 28, vortex finder 42 and the lower surface of cover liner 24 therebetween.

As best seen in FIG. 2, the conical portion 46 of insert body 44 and the conical portion 30 of liner body 26 have mating interengageable formations which prevent longitudinal movement of the insert body 44 with respect to the liner body 26. In particular, the conical portion 30 of liner body 26 has an internal circumferential recess 52 adjacent the upper end of conical portion 46 of insert body 44. Recess 52 is defined by a generally upwardly facing shoulder 50, a generally downwardly facing shoulder 54, cylindrical section 56 immediately above shoulder 50, and conical section 58 joining section 56 to shoulder 54. A mating projection 60 at the large or upper end of conical portion 46 of insert body 44 is received within recess 52. Projection 60 comprises an edge surface 62, common to the large end of the conical portion 46 as a whole as well as to the projection 60, which forms a generally upwardly facing shoulder abutting shoulder 54 of recess 52. Projection 60 further comprises a downwardly facing shoulder 64 abutting shoulder 50, cylindrical section 66 immediately above shoulder 64 and mating with cylindrical section 56, and conical section 68 joining cylindrical section 66 to shoulder 62 and mating with conical section 58.

Shoulders 64 and 50 serve as first stop surfaces on the insert body and liner body respectively for preventing downward movement of the insert body with respect to the liner body. Shoulders 62 and 54 serve as second stop surfaces on the insert body and liner body respectively for preventing upward movement of the insert body with respect to the liner body. Since both sets of stop surfaces are disposed adjacent the upper end of conical portion 46, movement of the upper end of the insert body with respect to the lower end of the insert body is also prevented even if the insert is comprised of a relatively soft material such as the elastomer shown.

The outer surface of conical portion 46 further comprises a cylindrical section 70 of smaller diameter than section 66 immediately below shoulder 64. Conical portion 30 of liner body 26 has a complimentary cylindrical section 72, the liner body terminating at the lower end of section 72. The remainder of the outer surface of the insert body 44 abuts the lower part of the housing 10 and generally conforms to its configuration. While surfaces 66, 64, and 70 form irregularities on the outer surface of portion 46 of insert body 44, it can be seen that this portion is still generally conical in configuration. The same can be said of the generally conical portion 30 of liner body 26 with respect to surfaces 54, 58, 56, 50 and 72.

Shoulders 62 and 54 are beveled or inclined downwardly from their radially outer to the radially inner extremities. Thus shoulder 62 forms a generally axial protrusion 63, and axially facing shoulder 54 is undercut to receive this protrusion. This arrangement provides an especially firm locking of the insert body 44 to the liner body 26, such locking being particularly helpful when the insert body is flexible. The locking action not only prevents longitudinal movement of the insert body with respect to the liner body but also prevents the upper edge of the insert body from moving radially out of the recess 52. The mating bevelled surfaces 54 and 62 further serve to prevent the materials being handled by the cyclone from leaking between the insert body and the liner body. It can be seen that, if the housing 10 is formed of metal, its interior can be unmachined, due to the excellent alignment of the liner body and insert body brought about by their mating interengageable formations. In order to allow installation of the insert body 44 in the liner body 26, at least one of the bodies must be sufficiently flexible to allow the outer edge of shoulder 62 to be snapped past the inner edge of shoulder 54 and into place in the recess 52. The remaining mating surfaces of the two bodies 26 and 44 will drop easily into place and the insert body 44 will then be locked in the liner body 26. It is also highly desirable, for both installation and removal purposes, that the outer diameter of the downwardly facing or first stop surface 64 be no greater than the inner diameter of the uppermost shoulder 54 of the recess 52 which abuts the upper edge of the insert body.

If one of the bodies 26, 44, preferably the insert body 44, is formed of a flexible material such as a soft elastomer, the beveled shoulders 62 and 54 also facilitate removal of the insert body 44 from the liner body 26. To remove the insert body, a suitable tool may be wedged between the shoulders 54 and 62 and turned to force a part of protrusion 63 out of the recess 52. Alternatively, pressure may be applied to the exterior of the liner body 26 at a point near the top of the recess 52 to similarly force a part of the protrusion 63 out of the recess. Protrusion 63 will overlap the inner surface of the liner body immediately above the recess 52 and prevent the part of the projection 60 which has thus been removed from the recess 52 from snapping back in. The tool, which is now disposed between the inner surface of the liner body and the part of the protrusion 63 which has been removed from the recess 52, can then simply be passed circumferentially around the upper end of the insert body forcing the entire protrusion 63 out of the recess 52. The insert body 44 can then be pulled upwardly and out of the liner body 26.

As mentioned above the beveled shoulders 54 and 62 are particularly useful when the insert body 44 is formed of a relatively flexible material, e.g. soft elastomer as shown. However, it should be understood that the insert body can be formed of virtually any material, either rigid or soft. If the shoulders 62 and 54 are beveled as shown, it is merely necessary to provide sufficient flexibility for assembly in at least one of the bodies. Furthermore, if it is desired to employ relatively rigid materials in both bodies, the angle of the bevels with respect to horizontal can simply be reduced or the shoulders 54 and 62 can even be made flat. The rigidity of the two bodies in such a case will reduce the need for the locking action of the beveled shoulders. In general, the angle of the bevels with respect to horizontal should preferably be sufficient to provide the locking action described above and to provide a protrusion such as 63 but not so great as to unduly interfere with installation or removal of the insert body. For insert bodies of relatively soft, flexible elastomer, as well as many other materials, an angle of 5° to 30° is preferable with an angle of 7° to 10° considered optimum. Insert body 44 and the liner body 26 can be formed of the same material or of different materials. In particular, the insert body 44 can be formed of a material which is highly resistant to abrasion by the particular substance to be handled by the cyclone. However, this material may be quite expensive or may have other characteristics which make it undesirable for use throughout the entire liner. Thus the liner body 26 may be formed of a second material which is perhaps less resistant to abrasion, such resistance not being as critical in the upper parts of the cyclone, but which has other desirable properties.

Figure 3:
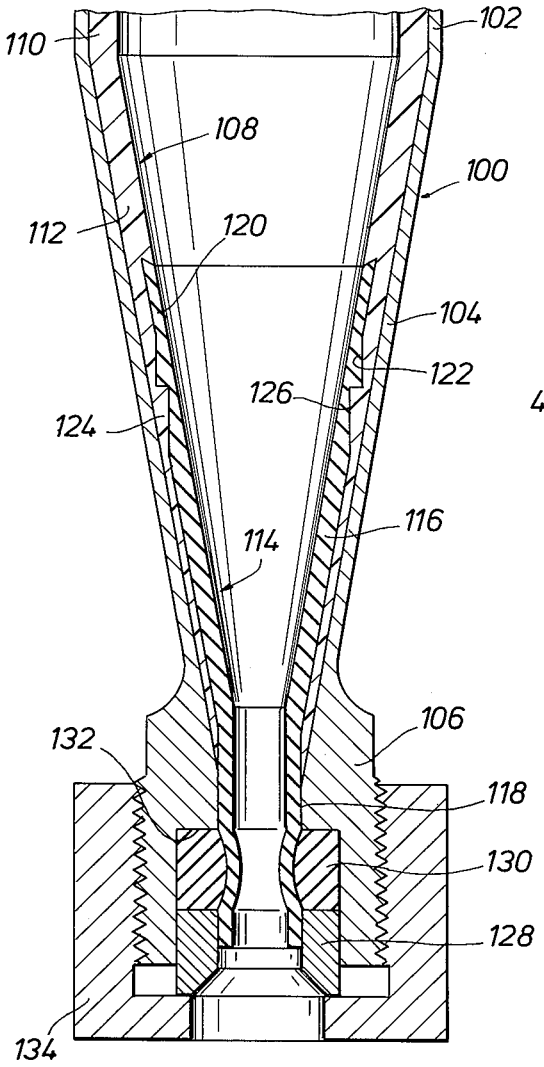
FIG. 3 is a partial longitudinal sectional view, similar to that of FIG. 2, of a second embodiment of the invention.

Referring now to FIG. 3, there is shown a second embodiment of the invention. The upper parts of the cyclone assembly broken off in FIG. 3 are substantially identical to the analogous parts of the embodiment of FIGS. 1 and 2. The assembly of FIG. 3 comprises a housing 100 having an upper cylindrical portion 102, a central conical portion 104, and a lower portion 106. A liner body 108 is disposed in the housing 100 and has an upper cylindrical portion 110 and a lower generally conical portion 112 disposed adjacent portions 102 and 104 respectively of the housing. An insert body 114 has an upper generally conical portion 116 disposed in the lower part of the conical portion 112 of the liner body 108. Insert body 114 also has a lower cylindrical portion 118, the major part of which extends downwardly beyond the lower end of the conical portion 112 of the liner body 108.

Insert body 114 has an external circumferential projection 120, identical to projection 60 of the embodiment of FIGS. 1 and 2, at its upper end. Projection 120 is received in an internal circumferential recess 122, identical to the recess 52 of the embodiment of FIGS. 1 and 2, in the liner body 108. The outer surface of the conical portion 116 of the insert body 114 has a cylindrical section 124 immediately below projection 120, and the inner surface of the conical portion 112 of the liner body 108 has a mating cylindrical section 126. The main difference between bodies 108 and 114 of FIG. 3 and bodies 26 and 44 of FIGS. 1 and 2 is that, in the former, the liner body 108 does not terminate at the lower end of section 126, i.e., intermediate the ends of the conical portion of the insert body. Rather it extends along the entire length of the conical portion 116 and terminates adjacent the upper end of cylindrical portion 118 of the insert body 114. This allows the lower part of conical portion 116 of the insert body 114 to be made thinner. Cost of the insert body 114 is thus reduced. This expedient may be useful in situations in which the material of the insert body is especially expensive and/or the life of the liner body is several times that of the insert body. It is noted that the projection 120 and mating recess 122 provide the same control of the insert body as a whole as well as its upper end as in the embodiment of FIGS. 1 and 2.

Another difference between the embodiment of FIG. 3 and that of FIGS. 1 and 2 is the provision of means in the lower portion of the assembly for varying the effective diameter of the outlet. The lower end of cylindrical portion 118 of insert body 114 is surrounded by an annular bearing nut 128 and by a resilient annulus 130 axially inwardly of and abutting nut 128. A downwardly facing shoulder 132 formed in the portion 106 of the housing 100 abuts the upper edge of annulus 130. Housing portion 106 also abuts the radially outer surface of the annulus 130. An adjusting nut 134 is threaded onto the housing portion 106 and abuts the lower edge of nut 128.

It can be seen that if the nut 134 is moved upwardly on the housing portion 106, the annulus 130 will be axially compressed and its elastomeric material will be forced radially inwardly making the opening through the annulus 130 smaller. Since the insert body 114 is flexible, the part of portion 118 within annulus 130 will also be forced inwardly constricting the effective lower outlet. To increase the size of the lower outlet the nut 134 is moved downwardly on the housing portion 106.

Figure 4:
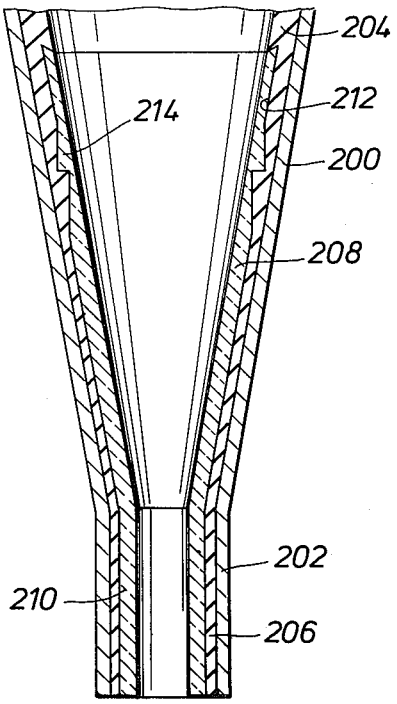
FIG. 4 is a partial longitudinal sectional view, similar to that of FIG. 2, of a third embodiment of the invention.

FIG. 4 depicts a portion of a third embodiment of the invention. The embodiment of FIG. 4 includes a cover (not shown) and a housing substantially identical to housing 10 and having a cylindrical upper portion (not shown), a central conical portion 200, and a cylindrical lower portion 202. The assembly further comprises a liner body having an upper cylindrical portion (not shown), a central generally conical portion 204, and a lower cylindrical portion 206. An insert body having an upper generally conical portion 208 and a lower cylindrical portion 210 is disposed coaxially within the liner body with conical portion 208 within the lower part of conical portion 204 and cylindrical portion 210 within cylindrical portion 206.

The conical portion 204 of the liner body has an internal circumferential recess 212 identical to recess 52 of FIG. 2. The upper end of the conical portion 208 of the insert body has a mating projection identical to projection 60 of FIG. 2. The primary difference between the embodiment of FIG. 4 and that of FIGS. 1 and 2 is that, in the former, the liner body extends along the entire length of the insert body rather than terminating above the lower end of the insert body. This decreases the cost of the insert body, as explained in connection with the embodiment of FIG. 3. It also allows the liner body to form a protective backing between the insert body and the housing. This latter feature is useful, for example, when the insert body is formed of a frangible material such as the ceramic shown and the liner body is formed of a material such as a soft elastomer capable of cushioning the ceramic.

Figure 5:
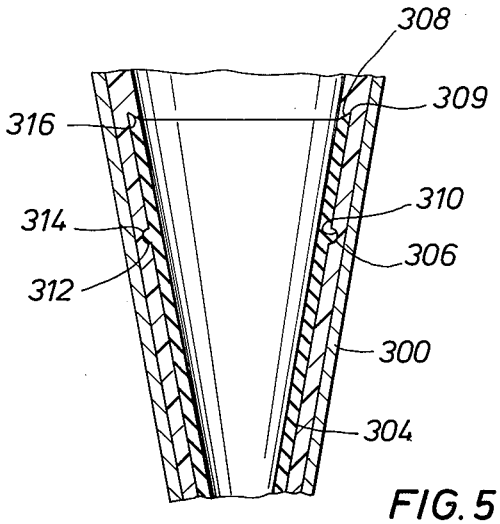
FIG. 5 is a partial longitudinal sectional view, similar to that of FIG. 2, of a fourth embodiment of the invention.

FIG. 5 shows still another embodiment of the invention. The assembly of FIG. 5 comprises a housing identical to that of FIGS. 1 and 2 and including a conical portion 300. A liner body disposed within the housing includes a generally conical portion 302. An insert body includes a generally conical portion 304 disposed in the lower or smaller part of conical portion 302 of the liner body. The primary difference between the embodiment of FIG. 5 and that of FIGS. 1 and 2 is the configuration of the interengageable formations. The conical portion 304 of the insert body has an external circumferential projection 306 adjacent its upper end but spaced from the edge surface 308. Projection 306 is of semicircular cross-sectional configuration. Conical portion 302 of the liner body has a mating internal circumferential recess 310. It can be seen the generally downwardly facing portion 312 of projection 306 and the mating portion of recess 310 form first stop surfaces for preventing downward movement of the insert body with respect to the liner body. Similarly, the generally upwardly facing portion 314 of projection 306 and the mating portion of recess 310 form second stop surfaces for preventing upward movement of the insert body. The projection 308 and recess 310 are disposed close enough to the upper edge 308 of the insert body to not only prevent movement of the insert body as a whole, but also to prevent movement of the upper part of the insert body with respect to the lower part. The inner surface of conical portion 302 of the liner body has a generally axially facing surface or shoulder abutting the upper edge surface 308 of the insert body and thus further prevent relative movement between the two bodies. Surfaces 308 and 316 are beveled downwardly from their radially outer to the radially inner extremities to form an axial protrusion 309 on edge 308 and a mating undercut on surface 316. This provides a firm lock between the two bodies, assists in removal of the insert body, and prevents leakage, as explained above. The outer diameter of stop surface 312, i.e., the outermost point of projection 306, is no greater than the inner diameter of the surface 316 to allow for ease of assembly and disassembly. The primary advantage of the embodiment of FIG. 5 is that the projection 306 and recess 310 are simpler and less expensive to form than the projections and recesses of the other embodiments shown. However, the other type of projection and recess, as shown in FIG. 2 provides a firmer lock between the two bodies.

Figure 6:
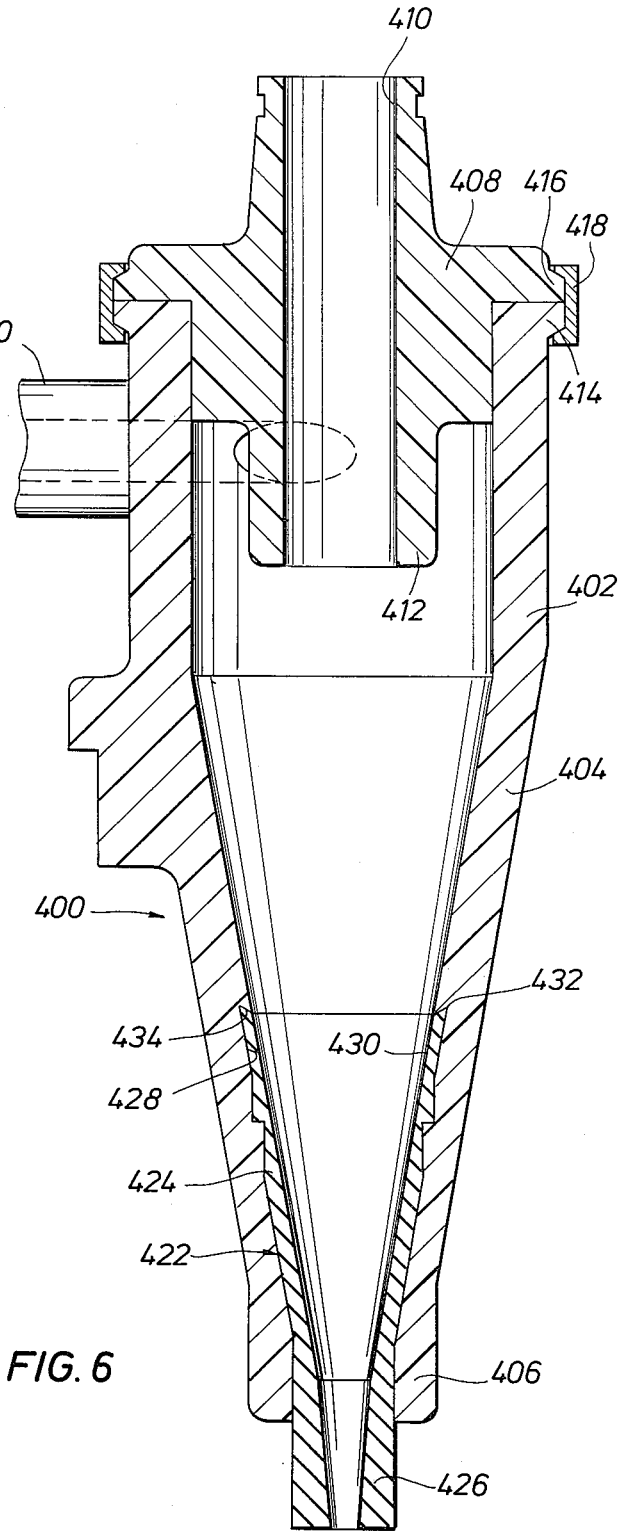
FIG. 6 is a longitudinal cross section of a cyclone assembly incorporating a fifth embodiment of the invention.

Referring finally to FIG. 6 there is shown an embodiment in which the insert body is inserted directly into the cyclone housing, the upper part of which is unlined. The housing 400 comprises a cylindrical upper portion 402, a generally conical central portion 404, and a cylindrical lower portion 406. The assembly further comprises an unlined cover 408 having an outlet 410 and an integral vortex finder 412. The upper end of the housing 400 and the cover 408 have abutting radial flanges 414 and 416 respectively which are held together by a clamp 418. The housing 400 has an inlet pipe 420 which communicates with the interior of the upper portion 402 of the housing and directs the incoming fluid tangentially against the inner surface of portion 402. The housing 400 and the cover 408 as shown are formed of a hard synthetic plastic. However, they could be formed of virtually any relatively rigid material.

An insert body 422 is disposed in the lower part of the housing 400. Insert body 422 has an upper generally conical portion 424 adjacent the lower part of conical portion 404 of housing 400, and a lower portion 426 whose interior is conical and whose exterior is cylindrical. Portion 426 extends through cylindrical housing portion 406 and downwardly therefrom; it can be cut transversely at any point along the internal conical portion to provide a required diameter of the apex opening, as might be desired for any specific purpose.

The conical portions 424 and 404 of insert body 422 and housing 400 respectively have mating interengageable formations which prevent longitudinal movement of the insert body 422 with respect to the housing 400. These formations include an internal circumferential recess 428, identical to recess 52 of FIG. 2, in the conical portion 404 of the housing 400, and a mating external circumferential projection 430 at the upper end of conical portion 424 of insert body 422 and identical to projection 60 of FIG. 2.

Recess 428 and projection 430 lock the upper end of the insert body in place in the housing 400 in the same manner that the projection 60 and recess 52 of FIGS. 1 and 2 lock the upper end of the insert body 44 in the liner body 26. Since the housing 400 is rigid, the insert 422 is preferably formed of a relatively flexible material such as the elastomer shown. The upper edge surface common to the conical portion 424 as a whole as well as to the projection 43 is beveled to form a protrusion 432. The mating generally axially facing surface 434 of the conical portion 404 of housing 400 is undercut to receive protrusion 432. This firmly locks the insert body in place and also assists in its subsequent removal as explained above.

Many modifications of the preferred embodiments described above can be made without departing from the spirit of the invention. For example, various features of the embodiments shown can be interchanged. Other modifications might involve changes in the configurations of the interengageable projections and recesses or in the protrusions at the upper edges of the insert bodies. It would also be possible to provide interengageable formations comprising projections on the housing or liner body and recesses in the insert body. It is thus intended that the scope of the invention be limited only by the claims which follow.

We claim:

1. A cyclone liner assembly comprising:

a hollow liner body having a generally conical portion;

a tubular insert body having a generally conical portion disposed at least partially within said liner body coaxial therewith and adjacent the smaller end of the conical portion of said liner body;

said liner body and said insert body having preformed interengageable formations, generally laterally projecting as to one of said bodies and generally laterally receiving as to the other of said bodies, for preventing longitudinal movement of said insert body with respect to said hollow body.

2. The cyclone liner assembly of claim 1 wherein said formations include a generally axially facing first stop surface on said insert body and an abutting oppositely directed first stop surface on said liner body, said first stop surfaces being disposed intermediate the ends of the conical portion of said insert body.

3. The assembly of claim 2 wherein said formations include an internal circumferential recess in the conical portion of said liner body and an external circumferential projection adjacent the larger end of the conical portion of said insert body, said first stop surfaces being formed on said projection and in said recess respectively.

4. The assembly of claim 3 wherein said first stop surface of said insert body faces generally toward the smaller end of the conical portion of said insert body.

5. The assembly of claim 4 wherein said insert body comprises an edge surface facing generally axially toward the larger end of said conical portion of said liner body, said edge surface including an annular generally axial protrusion, and wherein the interior of said conical portion of said liner body includes a generally axially facing surface opposed to said edge surface, said axially facing surface being undercut to receive said protrusion, and wherein the inner diameter of said first stop surface of said insert body is no greater than the outer diameter of said undercut surface of said liner body.

6. The assembly of claim 4 wherein said insert body terminates at the larger end of the conical portion thereof, the conical portion of said insert body and said projection having a common edge surface, said edge surface serving as a generally axially facing second stop surface, and said liner body having an abutting oppositely directed second stop surface formed in said recess.

7. The assembly of claim 6 wherein said first stop surfaces are shoulders and wherein said second stop surfaces are shoulders beveled downwardly from their radially outer to their radially inner extremities.

8. The assembly of claim 7 wherein said insert body is flexible.

9. The assembly of claim 7 wherein the conical portion of said insert body includes a pair of cylindrical sections adjoining said first stop surface on axially opposite sides thereof, one of said cylindrical sections being of greater diameter than the other and being located closer to the larger end of said conical portion.

10. The assembly of claim 9 wherein the larger one of said cylindrical sections is joined to said second stop surface of said insert body by an external conical section of said conical portion.

11. The assembly of claim 1 wherein said insert body comprises an edge surface facing generally axially toward the larger end of said conical portion of said liner body, said edge surface including an annular generally axial protrusion, and wherein the interior of said conical portion of said liner body includes a generally axially facing surface opposed to said edge surface, said axially facing surface being undercut to receive said protrusion.

12. The assembly of claim 11 wherein said insert body is flexible.

13. The assembly of claim 1 further comprising a cyclone housing surrounding said liner body.

14. The assembly of claim 1 wherein said liner body extends along substantially the entire length of said insert body.

15. The assembly of claim 1 wherein said insert body extends axially beyond said liner body.

16. The assembly of claim 15 wherein said liner body terminates at the smaller end of said conical portion thereof, and wherein the smaller end of the conical portion of said insert body extends axially beyond the smaller end of the conical portion of said liner body.

17. The assembly of claim 16 wherein said insert body further comprises a cylindrical portion adjoining the smaller end of the conical portion of said insert body.

18. The assembly of claim 15 wherein said liner body terminates at the smaller end of the conical portion thereof, and wherein said insert body further comprises a cylindrical portion adjoining the smaller end of the conical portion of said insert body, at least a part of said cylindrical portion extending axially beyond the smaller end of the conical portion of said liner body.

19. The assembly of claim 1 wherein one of said bodies is sufficiently resilient to permit engagement and disengagement of said formations.

20. A cyclone assembly comprising:

a hollow cyclone body having a generally tangentially directed inlet, a generally axially directed first outlet, and a generally conical portion disposed generally between said inlet and said first outlet;

a tubular insert body having a generally conical portion disposed at least partially within said hollow body coaxial therewith and adjacent the smaller end of the conical portion of said hollow body;

said hollow body and said insert body having preformed interengageable formations, generally laterally projecting as to one of said bodies and generally laterally receiving as to the other of said bodies, for preventing longitudinal movement of said insert body with respect to said hollow body;

and a cover mounted on said cyclone body and having a generally axially directed second outlet.

21. The cyclone assembly of claim 19 wherein said formations include a generally axially facing first stop surface on said insert body and an abutting oppositely directed first stop surface on said cyclone body, said frist stop surfaces being disposed intermediate the ends of the conical portion of said insert body.

22. The cyclone assembly of claim 21 wherein said formations include an internal circumferential recess in the conical portion of said cyclone body and an external circumferential projection adjacent the larger end of the conical portion of said insert body, said first stop surfaces being formed on said projection and in said recess respectively.

23. The cyclone assembly of claim 22 wherein said first stop surface of said insert body faces generally toward the smaller end of the conical portion of said insert body.

24. The cyclone assembly of claim 23 wherein said insert body comprises an edge surface facing generally axially toward the larger end of said conical portion of said cyclone body, said edge surface including an annular generally axial protrusion, and wherein the interior of said conical portion of said cyclone body includes a generally axially facing surface opposed to said edge surface, said axially facing surface being undercut to receive said protrusion, and wherein the inner diameter of said first stop surface of said insert body is no greater than the outer diameter of said undercut surface of said cyclone body.

25. The cyclone assembly of claim 23 wherein said insert body terminates at the larger end of the conical portion thereof, the conical portion of said insert body and said projection having a common edge surface, said edge surface serving as a generally axially facing second stop surface, and said cyclone body having an abutting oppositely directed second stop surface formed in said recess.

26. The cyclone assembly of claim 25 wherein said first stop surfaces are shoulders and wherein said second stop surfaces are shoulders beveled downwardly from their radially outer to their radially inner extremities.

27. The cyclone assembly of claim 26 wherein said insert body is flexible.

28. The cyclone assembly of claim 26 wherein the conical portion of said insert body includes a pair of cylindrical sections adjoining said first stop surface on axially opposite sides thereof, one of said cylindrical sections being of greater diameter than the other and being located closer to the larger end of said conical portion.

29. The cyclone assembly of claim 28 wherein the larger one of said cylindrical sections is joined to said second stop surface of said insert body by an external conical section of said conical portion.

30. The cyclone assembly of claim 20 wherein one of said bodies is sufficiently resilient to permit engagement and disengagement of said formations.

* * * * *